US005632137A

United States Patent [19]

Kolmes et al.

[11] Patent Number: 5,632,137

[45] Date of Patent: May 27, 1997

[54] COMPOSITE YARNS FOR PROTECTIVE GARMENTS

[75] Inventors: Nathaniel H. Kolmes, 1740 5th Street Dr. N.W., Hickory, N.C. 28606; Harold F. Plemmons, 50 Seagate Dr., Unit 1203B, Naples, Fla. 33940

[73] Assignees: Nathaniel H. Kolmes, Hickory, N.C.; Harold F. Plemmons, Naples, Fla.

[21] Appl. No.: 350,616

[22] Filed: Dec. 7, 1994

Related U.S. Application Data

[63] Continuation-in-part of Ser. No. 641,785, Jan. 16, 1991, Pat. No. 5,423,168, which is a continuation-in-part of Ser. No. 366,886, Jun. 13, 1989, abandoned, which is a continuation-in-part of Ser. No. 176,075, Mar. 31, 1988, abandoned, and a continuation-in-part of Ser. No. 202,338, Jun. 6, 1988, Pat. No. 4,838,017, said Ser. No. 176,075, is a continuation of Ser. No. 766,846, Aug. 16, 1985, abandoned, said Ser. No. 202,338, is a continuation of Ser. No. 915,140, Oct. 3, 1986, Pat. No. 4,777,789.

[51] Int. Cl.[6] ..... D02G 3/12; D02G 3/18

[52] U.S. Cl. ..... 57/212; 57/213; 57/216; 57/222

[58] Field of Search ..... 57/212, 213, 216, 57/222

[56] References Cited

U.S. PATENT DOCUMENTS

| | | | |
|---|---|---|---|
| 4,384,449 | 5/1983 | Byrnes, Sr. et al. | 57/902 X |
| 4,470,251 | 9/1984 | Bettcher | 57/230 |
| 4,777,789 | 10/1988 | Kolmes et al. | 57/210 |
| 4,838,017 | 6/1989 | Kolmes et al. | 57/210 |
| 4,912,781 | 4/1990 | Robins et al. | 2/167 |
| 4,936,085 | 6/1990 | Kolmes et al. | 57/210 |
| 5,070,540 | 12/1991 | Bettcher et al. | 57/902 X |
| 5,177,948 | 1/1993 | Kolmes et al. | 57/229 |
| 5,423,168 | 6/1995 | Kolmes et al. | 57/229 |

*Primary Examiner*—William Stryjewski
*Attorney, Agent, or Firm*—Rhodes, Coats & Bennett, L.L.P.

[57] ABSTRACT

Composite yarns having a total diameter of less than about 0.017 inch are formed with one or more core strands, each having a denier in the range of 100–300, preferably 150–300; a first covering strand of stainless steel wire having a diameter of from 0.0015 to 0.0030 inch; and a second covering formed of one or more strands which may be selected from the same material and range of sizes as the core strands.

32 Claims, 1 Drawing Sheet

COMPOSITE YARNS FOR PROTECTIVE GARMENTS

This application is a continuation-in-part of U.S. application No. 641,785, filed Jan. 16, 1991, issued as U.S. Pat. No. 5,423,168; which is in turn a continuation-in-part of Ser. No. 366,886, filed Jun. 13, 1989, now abandoned; which is in turn a continuation-in-part of Ser. No. 176,075, filed Mar. 31, 1988, now abandoned, and a continuation-in-part of Ser. No. 202,338, filed Jun. 6, 1988, issued as U.S. Pat. No. 4,838,017; said Ser. No. 176,075, is a continuation of Ser. No. 766,846, filed Aug. 16, 1985, abandoned, said Ser. No. 202,338 is a continuation of Ser. No. 915,140, filed Oct. 3, 1986, issued as U.S. Pat. No. 4,777,789.

BACKGROUND OF THE INVENTION

The present invention relates to composite yarns useful in the manufacture of protective garments, such as cut and puncture resistant glove liners to be worn by doctors, dentists, nurses and other healthcare personnel beneath latex gloves.

Latex gloves are commonly worn by healthcare personnel as barrier protection against diseases carried by a patient's blood and other body fluids. Use of this protection has become particularly critical with the advent of AIDS.

Unfortunately, latex gloves do not provide any protection against cuts or needle punctures which occasionally occur. These cuts and punctures are especially hazardous during surgery, since body fluids can enter the glove and the user's body through the cut or puncture created.

To address this problem, it has been suggested that medical personnel should wear cut-resistant safety gloves beneath the latex gloves. Safety gloves, which were originally designed to be worn by meat cutters, sheet metal workers, and the like, have proven to be unsuitable for use by healthcare personnel, however, since they are bulky, eliminate tactile sensation, and impede delicate manipulations required by healthcare personnel in the performance of their duties.

Examples of patents describing safety gloves exhibiting cut-resistant characteristics, and composite yarns used in the manufacture of such gloves, include U.S. Pat. No. 4,384,449 to Byrnes et al, which describes gloves manufactured from a composite yarn having a first core strand of wire which preferably has a diameter of from about 0.004 inch to about 0.006 inch, a second core strand of an aramid, and two covering strands of an aramid. The aramid strands have deniers of from about 200 to about 1500, preferably 200 to 400.

U.S. Pat. No. 4,470,251 to Bettcher describes safety gloves manufactured with a similar composite yarn; namely, a yarn having two core strands of annealed stainless steel wire, one core strand of an aramid, one covering strand of an aramid and one covering strand of nylon. The steel wire has a diameter of from 0.002 to 0.006 inch, and the aramid strand has a denier of from 500 to 1100 in the core strand and 400 in the covering strand.

Safety gloves are also described in U.S. Pat. Nos. 4,777,789 and 4,838,017 to Kolmes et al. The gloves described in these patents are prepared using a composite yarn having one or more core strands of an extended-chain polyethylene such as Spectra, manufactured by Allied-Signal, Inc., a core strand of wire having a diameter of 0.003 to 0.006 inch, and one or more covering strands of Spectra, nylon or other fiber which has a denier of 200 to 1500.

Gloves described in U.S. Pat. No. 4,936,085 to Kolmes et al, are manufactured with a composite yarn having at least one core strand of fiberglass, and at least two covering strands, one of which is fiberglass. The fiberglass has a denier in the range of from about 185 to about 2000, with a range of 375 to 1000 being preferred for the core and a range of 500 to 1000 being preferred for the covering. The preferred total denier of the yarn is in the range of about 3000 to about 6000.

U.S. Pat. No. 5,177,948 to Kolmes et al, which is a continuation-in-part of the application leading to U.S. Pat. No. 4,936,085, further discloses that the non-fiberglass fibers may include Spectra or an aramid.

In addition to conventional safety gloves of the type described in the aforesaid patents, surgical glove liners have also been knitted using 100% Spectra fibers. There is still a need, however, for an even lighter, smaller composite yarn strand that exhibits cut-resistant properties, yet may be used, for example, to form glove liners beneath surgical gloves. Such glove liners must afford a high degree of flexibility and allow a maximum of finger dexterity. Yet these glove liners must still exhibit a high degree of cut and puncture resistance.

SUMMARY OF THE INVENTION

The present invention relates to such new and improved composite yarns, which may be used to form such items as surgical glove liners and other protective garments which are manufactured utilizing these improved yarns.

Surprisingly, it has been discovered that it is possible to produce highly desirable composite yarns from materials similar to those described in the preceding prior art, but with strand diameters and/or yarn deniers substantially less than those contemplated or recommended heretofore or in the prior art disclosures.

The resultant yarns, due to their smaller diameters, can be knit on much finer gauge knitting machinery, i.e., a 13 gauge knitting machine, as opposed to a 5 or 7 gauge machine, to produce a tightly knit fabric which is resistant to cuts and punctures. Protective garments, e.g., glove liners, formed from this fabric are far superior to garments formed from prior art composite yarns, since they are much thinner and more flexible, thus affording a greater tactile sensation, and permitting the user to engage in more delicate manipulations.

Specifically, it has been found that a fine diameter wire can be used as an inner wrap around one or more nonmetallic core yarns, then be wrapped by one or more outer covers of non-metallic yarns to from the small diameter, lightweight composite yarn of the present invention. The composite yarns of the present invention comprise a core of one or two strands, each having a denier in the range of from about 100 to 300. Where two core strands are used, they may be parallel, twisted, or plied. The denier of the combined strands in the core is preferably from about 150 to about 300. A first covering strand of stainless steel wire having a diameter of from 0.0015 to 0.0030 inch is wrapped around the core in a first direction. A second cover or wrap is formed of two strands wrapped in the opposite direction. Each of the two strands in the outer cover has a denier of from about 100 to about 300, and are preferably of the same composition and denier as the core strand. The core, inner wrap, and outer cover must be so selected that the diameter of the composite yarn is in the range of 0.010–0.017.

The fine diameter wire inner wrap cover binds the core yarns together and provides the cut-proof or cut-resistant characteristic. Further, the filamentary nature of the yarns in the outer cover provide a smooth surface which minimizes cutting or rupture of the yarn. Use of the wire in the inner wrap rather than in the core, as is the case in most cut-resistant yarns, makes the composite yarn stand up to repeated flexing. Because the wire strands are wrapped, and not parallel, any stress or strain on the wire yarns as flexing occurs is minimized.

An added advantage occurs because of the outer wrap. Should the wire in the inner cover rupture, the outer cover keeps the broken wire covered and protected.

As used herein, the term "strand" is intended to include wire, as well as continuous filament and staple yarns.

DETAILED DESCRIPTION OF THE PREFERRED EMBODIMENTS

Figure 2:
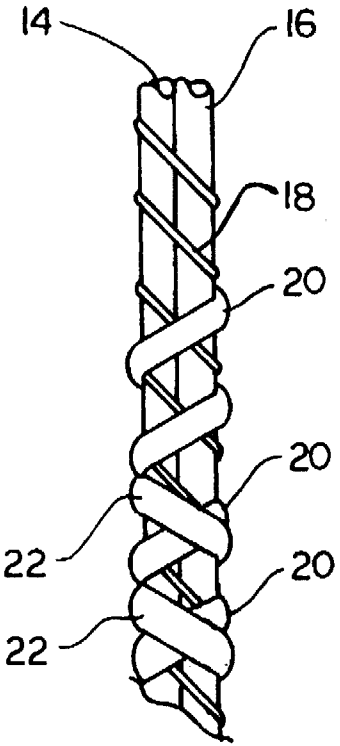
FIG. 2 is a perspective view similar to FIG. 1, except illustrating a yarn having two strands in the core.
Figure 1:
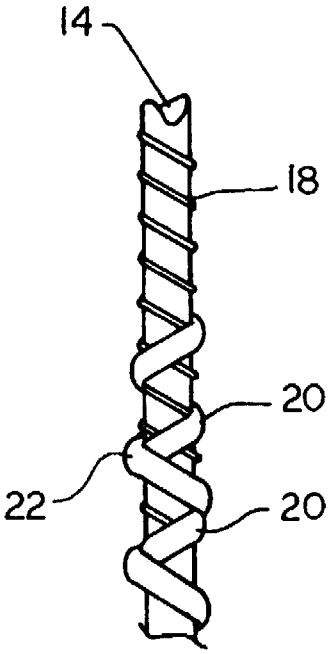
FIG. 1 is perspective view of a composite yarn within the scope of the present invention having a single strand in the core, showing portions of the inner wrap and outer wrap cut away for purposes of explanation.

The yarn illustrated in FIG. 1, is comprised of core strand 14, an inner wire wrap 18, and two layers 20, 22 of outer wrap arranged as an inner and outer covering wrap. The core strand 14 has a denier of from about 100 to about 300. The inner wrap 18 is formed of an annealed stainless steel wire having a diameter of about 0.0015 to about 0.0030 inch and is wrapped in a first direction about core strand 14. The outer wraps 20, 22 are formed of non-metallic strands, each having a denier of from about 100 to about 300. The innermost strand 20 of the outer wrap is wrapped around core strand 14 in the opposite direction from wire strand 18. The outermost strand 22 is wrapped in the opposite direction from innermost strand 20. FIG. 2 illustrates a similar yarn except having a second core yarn 16.

Core strands 14, 16 and the strands of outer cover 20, 22 are preferably continuous multi-filament synthetic yarns formed from an extended-chain polyethylene, preferably Spectra, manufactured by Allied-Signal, Inc.; an aramid, preferably Kevlar, such as Kevlar 29 manufactured by DuPont de Nemours; Vectran, a liquid crystal polymeric filament manufactured by Hoescht Celanese; nylon, or polyester. The filamentary nature of the yarns enhances the cut resistance, because such yarns exhibit a smoother surface causing the cutting edge to move faster and be less likely to cut through the fabric. Core strands 14, 16 and the strands of outer wrap 20, 22 may, but do not necessarily have the same composition and denier. The Spectra yarn having a denier of from about 100 to about 300 is particularly suitable for both the core strands and the outer covering strands.

Figure 3:
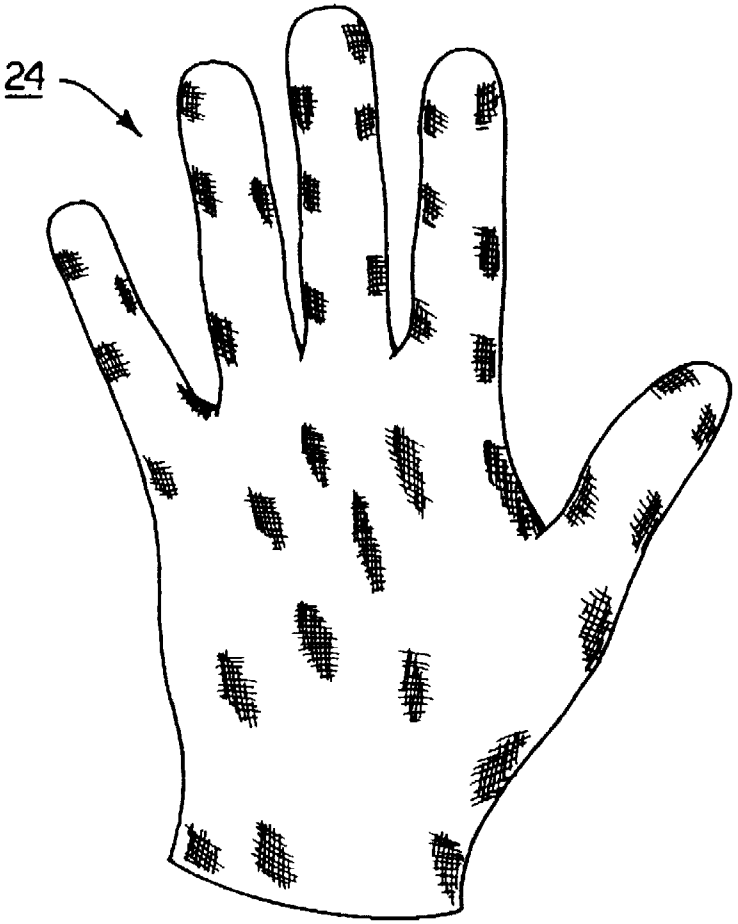
FIG. 3 is illustrative of a glove liner forming a part of the present invention, and made utilizing a yarn described herein.

The composite yarns of the present invention may be formed on a standard hollow spindle covering machine with the wraps in the inner cover being at the rate of from 8 to 15 turns per inch, with from 13 to 14 turns per inch being preferred. Similarly, the yarns in the outer cover are wrapped at a rate of 8–12 turns per inch with 11–12 tpi being preferred. The composite yarns thus formed are knit into glove liners 24 (FIG. 3).

The fiber deniers and the wire diameters used in preparing specific composite yarns should be selected so that the total diameter of the composite yarn is less than about 0.017 inch, in order for the yarn to be knittable on a 13 gauge knitting machine. It has been found that yarns having a diameter of more than 0.17 inch present problems in 13 gauge knitting equipment. Preferably, the composite yarn will have a diameter of from about 0.010 to about 0.017 inch. The denier of the composite yarn of the present invention ranges from 700–1200, but is preferably about 900.

In the preceding detailed description, certain specific terminology has been employed for the sake of clarity and particular embodiments described in accordance with 35 U.S.C. §112, but it is to be understood that the same is not intended to be limiting and should not be so construed in as much as the invention is capable of taking many forms and variations within the scope of the appended claims.

For example, additional core and wrap yarns can be used with the yarns shown and described, and multiple wire strands can be used, so long as the total diameter of the composite yarn permits knitting on a 13 gauge knitting machine. The covering strand and wire, while shown wrapped in one direction, can be wrapped in the other direction.

Furthermore, it will be apparent that the composite yarns of the present invention are useful in the manufacture of other articles, such as light-weight safety gloves to be worn without latex gloves, or in the production of various types of body armor. Also, the yarns described herein may be used to manufacture woven articles.

What is claimed is:

1. A composite, cut-resistant yarn comprising (a) a core formed of at least one yarn strand having a denier of from about 100 to about 300;

(b) an outer covering formed of at least one yarn strand having a denier of from about 100 to about 300;

(c) an inner covering strand of stainless steel wire having a diameter of from about 0.0015 to about 0.0030 inch; and (d) the diameter of the combination of said core strand and said inner and outer covering strands being no greater than 0.017 inch.

2. The yarn of claim 1, wherein said core and outer covering strands are continuous multi-filament strands selected from the group consisting of extended-chain polyethylene, aramid, liquid crystal polymer, nylon, and polyester.

3. The yarn of claim 1, wherein said core strand has the same composition and denier as said outer covering strand.

4. The yarn of claim 1, wherein said core and first covering strands have a denier of from 150 to 300.

5. The yarn of claim 1, wherein the diameter of said composite yarn is in the range of 0.010–0.017 inch.

6. The yarn of claim 1, wherein said at least one outer covering strand is wrapped about said core strand at the rate of from about 8 to about 12 turns per inch and the inner covering strand is wrapped about said core strand at the rate of from about 8 to about 15 turns per inch.

7. The yarn of claim 1, wherein said outer covering strand is wrapped about said core strand in one direction, and said inner strand is wrapped about said core strand in the opposite direction.

8. The yarn of claim 1 wherein said composite yarn has a denier of 700 to 1200.

9. The yarn of claim 1 wherein said composite yarn has a denier of about 900.

10. A protective garment knitted from a composite, cut-resistant yarn, said yarn comprising:

(a) a core formed of at least one yarn strand having a denier of from about 100 to about 300;

(b) an outer covering formed of at least one yarn strand having a denier of from about 100 to about 300;

(c) an inner covering strand of stainless steel wire having a diameter of from about 0.0015 to about 0.0030 inch; and (d) the diameter of the combination of said core strand and said inner and outer covering strands being no greater than 0.017 inch.

11. The garment of claim 10, wherein said garment is knitted on a 13 gauge knitting machine.

12. The garment of claim 10, wherein said garment is a glove liner adapted to be worn on one's hand beneath a glove.

13. A composite, cut-resistant yarn having a diameter of less than 0.017 inch, whereby said yarn is knittable on a 13 gauge knitting machine comprising (a) a core having at least one strand having a denier of from about 100 to about 300;

(b) an outer covering having at least one strand having a denier in the range of from about 100 to about 300; and (c) an inner covering strand of stainless steel wire having a diameter of from about 0.0015 to about 0.0030 inch.

14. The composite yarn of claim 13, wherein said composite yarn has a diameter of from about 0.010 to about 0.017 inch.

15. A knitted, cut and puncture resistant, glove liner suitable of the type to be worn beneath latex gloves, said glove liner being formed from a composite yarn comprising:

(a) a core having at least one strand having a denier of from about 100 to about 300;

(b) an outer covering having at least one strand having a denier of from about 100 to about 300; and (c) an inner covering strand of wire having a diameter of from about 0.0015 to about 0.0030 inch, said composite yarn having a total diameter of less than about 0.0017 inch.

16. A composite, cut-resistant yarn comprising:

(a) a core formed of at least one yarn strand having a denier of from about 100 to about 300;

(b) an outer covering formed of at least one yarn strand having a denier of from about 100 to about 300;

(c) a single inner covering strand of stainless steel wire having a diameter of from about 0.0015 to about 0.0030 inch; and (d) the diameter of the combination of said core strand and said inner and outer covering strands being no greater than 0.017 inch.

17. The yarn of claim 16, wherein said core and outer covering strands are continuous multi-filament strands selected from the group consisting of extended-chain polyethylene, aramid, liquid crystal polymer, nylon, and polyester.

18. The yarn of claim 16, wherein said core strand has the same composition and denier as said outer covering strand.

19. The yarn of claim 16, wherein said core and first covering strands have a denier of from 150 to 300.

20. The yarn of claim 16, wherein the diameter of said composite yarn is in the range of 0.010–0.017 inch.

21. The yarn of claim 16, wherein said at least one outer covering strand is wrapped about said core strand at the rate of from about 8 to about 12 turns per inch and the inner covering strand is wrapped about said core strand at the rate of from about 8 to about 15 turns per inch.

22. The yarn of claim 16, wherein said outer covering strand is wrapped about said core strand in one direction, and said inner strand is wrapped about said core strand in the opposite direction.

23. The yarn of claim 16 wherein said composite yarn has a denier of 700–1200.

24. The yarn of claim 16 wherein said composite yarn has a denier of about 900.

25. The yarn of claim 24 wherein said composite yarn has a denier of about 900.

26. A protective garment knitted from a composite, cut-resistant yarn, said yarn comprising:

(a) a core formed of at least one yarn strand having a denier of from about 100 to about 300;

(b) an outer covering formed of at least one yarn strand having a denier of from about 100 to about 300;

(c) a single inner covering strand of stainless steel wire having a diameter of from about 0.0015 to about 0.0030 inch; and (d) the diameter of the combination of said core strand and said inner and outer covering strands being no greater than 0.017 inch.

27. The garment of claim 26, wherein said garment is knitted on a 13 gauge knitting machine.

28. The garment of claim 26, wherein said garment is a glove liner adapted to be worn on one's hand beneath a glove.

29. A composite, cut-resistant yarn having a diameter of less than 0.017 inch, whereby said yarn can be knitted on a 13 gauge knitting machine comprising:

(a) a core having at least one strand having a denier of from about 100 to about 300;

(b) an outer covering having at least one strand having a denier in the range of from about 100 to about 300; and (c) a single inner covering strand of stainless steel wire having a diameter of from about 0.0015 to about 0.0030 inch.

30. The composite yarn of claim 29, wherein said composite yarn has a diameter of from about 0.010 to about 0.017 inch.

31. The yarn of claim 29 wherein said composite yarn has a denier of 700 to 1200.

32. A knitted, cut and puncture resistant, glove liner suitable of the type to be worn beneath latex gloves, said glove liner being formed from a composite yarn comprising:

(a) a core having at least one strand having a denier of from about 100 to about 300;

(b) an outer covering having at least one strand having a denier of from about 100 to about 300; and (c) a single inner covering strand of wire having a diameter of from about 0.0015 to about 0.0030 inch, said composite yarn having a total diameter of less than about 0.017 inch.

* * * * *

UNITED STATES PATENT AND TRADEMARK OFFICE

CERTIFICATE OF CORRECTION

PATENT NO. : 5,632,137
DATED : May 27, 1997
INVENTOR(S) : Nathaniel H. Kolmes

It is certified that error appears in the above-indentified patent and that said Letters Patent is hereby corrected as shown below:

In Column 5, line 37 (Claim 15), "0.0017" should be "0.017."

Signed and Sealed this

Twenty-third Day of September, 1997

*Attest:*

*Attesting Officer*

BRUCE LEHMAN

*Commissioner of Patents and Trademarks*